US007106870B2

(12) United States Patent
Meier et al.

(10) Patent No.: US 7,106,870 B2
(45) Date of Patent: Sep. 12, 2006

(54) METHOD FOR ADJUSTING A HEARING DEVICE TO A MOMENTARY ACOUSTIC SURROUND SITUATION AND A HEARING DEVICE SYSTEM

(75) Inventors: Hilmar Meier, Zürich (CH); Stefan Launer, Zürich (CH)

(73) Assignee: Phanak AG, Stafa (CH)

( * ) Notice: Subject to any disclaimer, the term of this patent is extended or adjusted under 35 U.S.C. 154(b) by 393 days.

(21) Appl. No.: 10/718,081

(22) Filed: Nov. 20, 2003

(65) Prior Publication Data

US 2005/0111680 A1 May 26, 2005

(51) Int. Cl.
*H04R 25/00* (2006.01)

(52) U.S. Cl. ..... 381/314; 381/315; 381/320

(58) Field of Classification Search ..... 381/314, 381/315, 320

See application file for complete search history.

(56) References Cited

U.S. PATENT DOCUMENTS 4,425,481 A * 1/1984 Mansgold et al. ..... 381/317
2002/0090098 A1 7/2002 Allegro et al.
2003/0076974 A1 4/2003 Barthel et al.

FOREIGN PATENT DOCUMENTS

EP 1 351 552 A2 10/2003

OTHER PUBLICATIONS

Phonak AG unpublished application "Automatic Magnetic Detection in Hearing Aids".

* cited by examiner

*Primary Examiner*—Daniel Swerdlow
(74) *Attorney, Agent, or Firm*—Pearne & Gordon LLP

(57) ABSTRACT

A method for adjusting a hearing device is disclosed in which one of several hearing programs can be selected, as well as a hearing device system to perform the method. The method comprises the steps of identifying a momentary acoustic surround situation and of arranging the selectable hearing programs according to the identified momentary acoustic surround situation. Therewith, the hearing device user is not obliged to know a predefined sequence of the selectable hearing programs; instead the hearing device user may easily select a hearing program which is regarded as the best one for the momentary acoustic situation. The selection is offered by the hearing device by analyzing the momentary acoustic situation. In addition, the hearing device user may easily select other hearing programs, namely by generating an activation signal, for example by pressing a button at the hearing device itself or at a remote control. For this, the automatic arrangement of the hearing programs in dependency of the momentary acoustic situation facilitates the selection dramatically.

20 Claims, 2 Drawing Sheets

METHOD FOR ADJUSTING A HEARING DEVICE TO A MOMENTARY ACOUSTIC SURROUND SITUATION AND A HEARING DEVICE SYSTEM

FIELD OF THE INVENTION

The present invention is related to a method for adjusting a hearing device to a momentary acoustic surround situation, in which hearing device one of several hearing programs can be selected, and to a hearing device system, in particular to a hearing aid.

BACKGROUND OF THE INVENTION

A method and a hearing device system are known from WO-A-01/20965 and US-A-2002/0037087 describing the same teaching. According to this known teaching, a momentary acoustic surround situation is being identified in the hearing device of the hearing system, and a corresponding hearing program—or the corresponding set of parameters saved in the hearing device, respectively—, which is most suitable for the identified acoustic surround situation, is being selected automatically. In order to provide to the hearing device user the possibility to switch off the automatic identification of the acoustic surround situation and the therewith connected automatic selection of a hearing program, an input unit, for example a switch at the hearing device or at a remote control, is provided, which input unit can be activated by the hearing device user.

Furthermore, hearing devices are known which provide the possibility to the hearing device user to manually select a most suitable hearing program out of a number of different hearing programs. The selection is only based on the judgment of the hearing device user himself and can be carried out by activating a remote control or a switch at the hearing device. If, for example, the hearing device user selects one hearing program out of five, he must know the predefined sequence of the selectable hearing programs in order to be able to get to the desired program. In other words, if, for example, the second hearing program is currently used and the hearing device user desires to select the forth hearing program, he must activate the remote control or the switch at the hearing device, respectively, twice. Accordingly, the hearing device user must know which hearing program is best suitable for the momentary acoustic situation, and, in addition, he must know at what position the desired hearing program is. For many hearing device users, this procedure of selecting a desired hearing program is difficult and awkward.

It is therefore an object of the present invention to provide a method and a hearing system, respectively, which support the hearing device user in its best possible way to help select the best suitable hearing program for a momentary acoustic surround situation, while, at the same time, giving the hearing device user the possibility to enter his personal wish by changing from a selected hearing program to another.

SUMMARY OF THE INVENTION

This object is obtained by a method to adjust a hearing device in which one of several hearing programs can be selected, the method comprising the steps of:

identifying a momentary acoustic surround situation; and arranging the selectable hearing programs according to the identified momentary acoustic surround situation.

By arranging the selectable hearing programs according to the identified momentary acoustic situation, the hearing device user is not obliged to know a predefined sequence of the selectable hearing programs; instead the hearing device user may easily select a hearing program which is regarded as the best one for the momentary acoustic situation. This selection is offered by the hearing device by analyzing the momentary acoustic situation. In addition, the hearing device user may easily select other hearing programs, namely by generating an activation signal, for example by pressing a button at the hearing device itself or at a remote control. For this, the automatic arrangement of the hearing programs in dependency of the momentary acoustic situation facilitates the selection dramatically.

Advantageous embodiments of the method according to the present invention as well as a hearing device system are also disclosed.

The invention will be further explained in detail by referring to drawings showing exemplified embodiments of the present invention.

Additional features of the present invention will become apparent to those skilled in the art upon consideration of the following detailed description of embodiments.

BRIEF DESCRIPTION OF THE DRAWINGS

It is shown in.

DETAILED DESCRIPTION OF THE INVENTION

Figure 1:
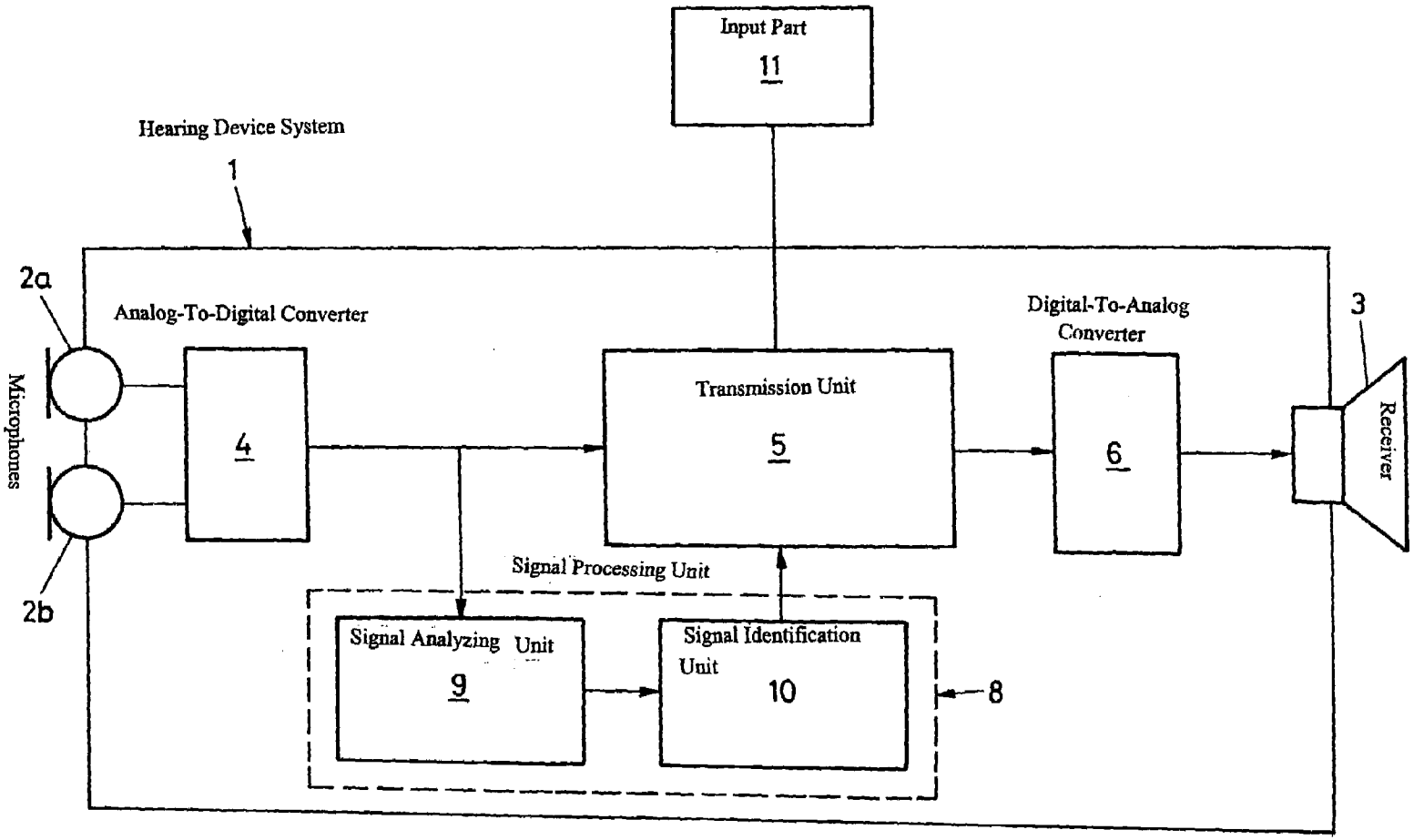
FIG. 1 a block diagram of a hearing system according to the present invention.

A hearing device system is schematically shown in a block diagram according to FIG. 1. Such a system comprises a hearing device 1 having electro-acoustic converters, namely at least a microphone, preferably two microphones 2*a* and 2*b* as shown in FIG. 1, as well as a receiver 3 (speaker). The microphones 2*a*, 2*b* are connected to an input to a transmission unit 5 adjustable in its transmission characteristics over an analog-to-digital converter 4, the transmission unit 5 being on its output side connected to the receiver 3 over a digital-to-analog converter 6. In the transmission unit 5, a number of different sets of parameters are selectable, each set belonging to a hearing program.

Instead of microphones 2*a*, 2*b* other input units may be connected to the transmission unit 5 in further embodiments of the present invention. Other input units may be, for example, the tele-coil, a FM—(Frequency Modulation) unit, a Bluetooth unit or a cellular phone having a wireless or wired connection to the hearing device.

Figure 2:
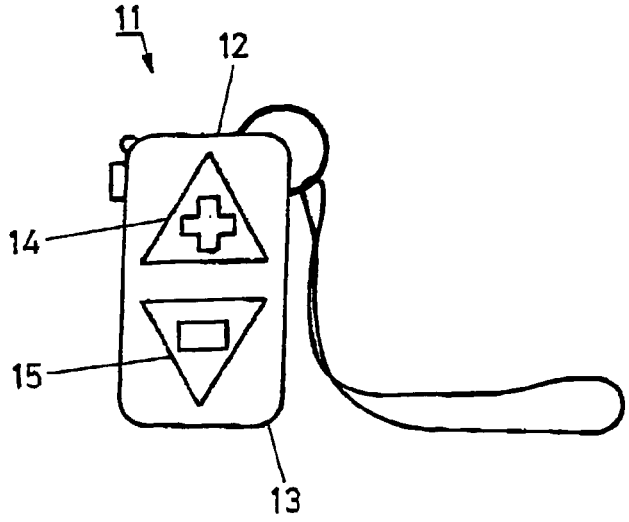
FIG. 2 an embodiment of an input unit belonging to the hearing device system according to FIG. 1.

A signal processing unit 8 is further comprised in the hearing device 1. The signal processing unit 8 itself comprises a signal analyzing unit 9 and a signal identification unit 10 connected to the signal analyzing unit 9. The signal analyzing unit 9 is connected to the output of the analog-to-digital converter 4.,The output of the signal identification unit 10 is connected to the transmission unit 5 to which an input part 11 is operationally connected in addition. This input part 11 forms, for the embodiment shown, a remote control 12 (FIG. 2) that is separated from the hearing device 1 and that communicates, as need be, wirelessly with the hearing device 1. The remote control 12, which is only shown schematically in FIG. 2, has a housing 13 in which the necessary electronic components (not shown in FIG. 2)

are arranged, as well as two buttons 14 and 15 which can be easily recognized and operated by the hearing device user.

It is also possible to incorporate the input part 11—instead of the realization as a remote control 12—into the hearing device 1 and to provide the buttons at the surface of the hearing device 1.

In either embodiment of the input part 11, i.e. as remote control 12 or as switch on the hearing device 1, one or two buttons can be used.

In a further embodiment of the present invention, the input part 11 is designed in order that the functions of the button or the buttons 14, 15 can be controlled by speech.

The identification of the momentary acoustic situation is, for example, implemented according to the known teaching disclosed in WO-A-01/20965 and US-A-2002/0037087. Therefore, its content is herewith incorporated by reference.

In summary, the identification of the momentary acoustic situation is performed as follows: In the signal analyzing unit 9, characteristic auditory-based features and/or technically-based features are extracted from the output signal of the analog-to-digital converter 4. Based on the features extracted in the signal analyzing unit 9, the momentary acoustic situation is determined by recognizing the same or similar patterns in the extracted features.

From the result of the signal identification unit 10, also called classifier, a corresponding output signal is generated for each available hearing program. This output signal, which may also be generated in the signal identification unit 10, is hereinafter called suitability measure. In other words, the suitability measure is a measure of how well a particular hearing program fits to the detected momentary acoustic situation.

These suitability measures are used, in one embodiment of the present invention, to arrange the hearing programs in a priority list; the hearing program having the highest suitability measure is at the first position while the hearing program having the lowest suitability measure is at the last position of the priority list.

In a further embodiment of the present invention, the presence of a new or changed priority list and/or one or several next best performing hearing programs are acoustically announced to the hearing device user before switching. This is achieved, for example, by a signal generating unit (not shown in FIG. 1) comprised in the transmission unit 5, the signal generating unit being capable of synthesizing a corresponding acoustic signal or by reading out a memory containing the necessary information to generate the corresponding acoustic signal, i.e. voice. In yet another example, the signal generating unit may be a player to play back recorded voice. The acoustic announcement may also be realized by other acoustic signals than voice. For example, it could be a single frequency beep, a jingle, music, etc.

In a further embodiment of the above-mentioned aspect of the present invention regarding the acoustic announcement, a new selection or an automatic adjustment of the hearing device must be accepted by the hearing device user in order to get activated. This can be by manually pressing a button at the hearing device or at the remote control. Activation by a voice signal of the hearing device user may also be implemented, wherein a voice recognition algorithm is being used to detect a code word.

FIG. 3 shows a flow chart representing five different hearing programs P1 to P5 which are available in the hearing device 1 (FIG. 1). For a first acoustic situation, the hearing program P1 has the highest suitability measure. According to the signal analyzing unit 9, the hearing program P1 is therefore best suitable for this first momentary acoustic situation. The hearing programs P2 to P5 follow each other in terms of its suitability measures, i.e. the hearing program P2 has the second best suitability measure, the hearing program P3 has the third best suitability measure, and so on, in respect to the first momentary acoustic situation.

Figure 3A:
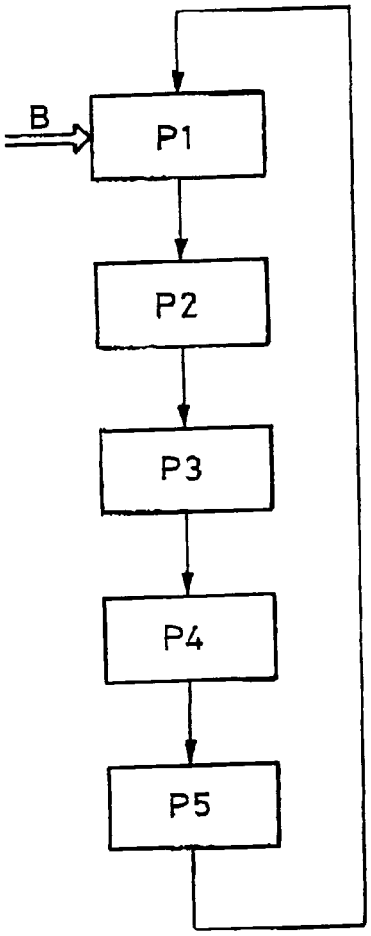
FIG. 3 a flow chart with selectable hearing programs in the hearing device.

As is illustrated in FIG. 3A, all the hearing programs P1 to P5 are, for the sake of its selection, arranged in a circular buffer.

Instead of arranging the hearing programs P1 to P5 in a circular buffer, a further embodiment may, for example, also consist in using a circular buffer of pointers each pointing to a memory section of the corresponding hearing program P1 to P5.

Once the circular buffer is set up as described above, the hearing device user may, starting from the first hearing program P1 having the highest suitability measure (arrow B in FIG. 3A), jump to the next best hearing program P2 having the second highest suitability measure by activating the hearing device 1 directly or over a remote control 12, respectively. Again, the activation may lie in pressing a button 14, 15 (FIG. 2) at the remote control 12 or at the hearing device 1. By this simple procedure, the hearing device user may correct the automatically selected hearing program P1 by a simple activation assuming that, if not the first hearing program P1, at least the second or third hearing program P2, P3 will meet the needs of the hearing device user.

Figure 3B:
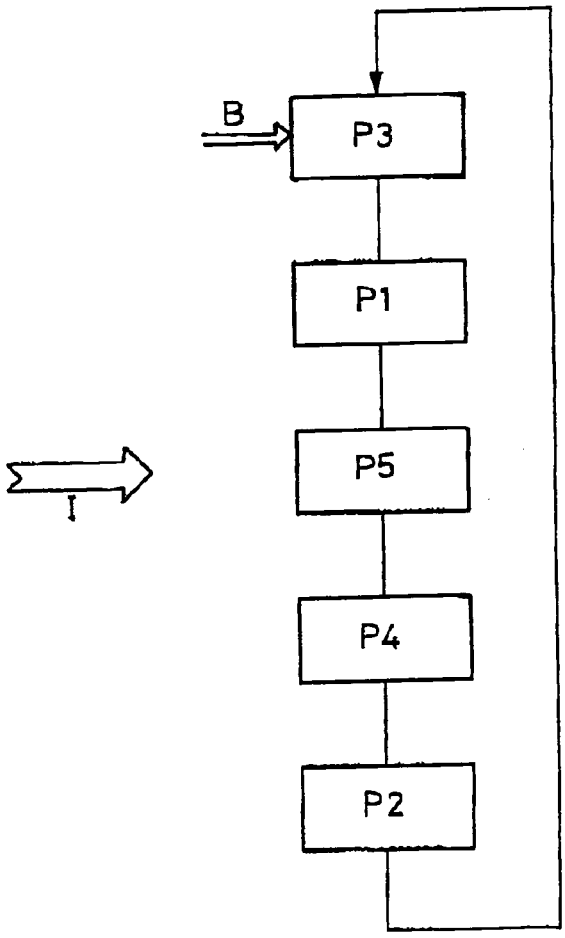

For a new or second detected acoustic situation, the hearing program P1 to P5 may be rearranged in a sequence as shown in FIG. 3B. According to the flow chart of FIG. 3B, the hearing program having the highest suitability measure is now P3. The sequence following the hearing program P3 is P1, P5, P4 and P2. Again, this sequence is calculated by the signal processing unit 8 applying the above-referenced algorithms. According to the present invention, the hearing device user may again change the preferred offered setting by simply activating the hearing device 1 directly or via the remote control 12.

According to the present invention, the hearing device user is not forced anymore to activate the hearing device 1 several times in order to get to the desired hearing program. In addition, the hearing device user does not have to know at which position the desired hearing program is arranged. The sequence of the selectable hearing programs P1 to P5 is arranged in accordance with the momentary acoustic situation determined by the signal processing unit 8 in order to simplify the selection of the desired hearing program by the hearing device user.

The described information of the signal processing unit 8 (FIG. 1) consists in particular in that probabilities are generated for each hearing program P1 to P5 in the classifier operating in the signal processing unit B. The determined probabilities provide information about its suitability to operate in the detected acoustic situation and therefore are referred to as suitability measures. In other words, the suitability measures provide information about the efficiency of a hearing program applied in a certain acoustic situation.

According to the above, the signal processing unit B suggests a best possible hearing program for a detected momentary acoustic situation. If, in addition, an input signal is detected at one of further inputs sources—as for example at a tele-coil (T-coil), an audio input or a FM—(Frequency Modulated) input, a Bluetooth receiver, an output signal of a cellular phone—, optimal parameters are suggested for a next best hearing program for this additional input source. The hearing device user may then select the second best hearing program in order to pay attention to the additional input source. These further input sources may, for example, also be incorporated into the priority list together with other possible hearing programs. For example, it might be possible to have the hearing program with the highest suitability measure at the first position and a hearing program handling a detected input source (e.g. at the T-coil) at the second position.

In view of the above-described aspect of the present invention, it is understood that the term "hearing program" means not only the handling of a detected acoustic situation but also the handling of a further input source (e.g. T-coil, Bluetooth device, cellular phone, FM module, etc.). Therefore, a signal of a further input source must also be understood as a momentary acoustic situation in the scope of this specification.

A possible technology to detect a further input source is disclosed by U.S. patent application with Ser. No. 10/452,731 which is hereby incorporated by reference.

In one embodiment of the present invention, the best suitable hearing program P1 or P3, respectively, may automatically be selected by the signal processing unit 8 of the hearing device 1.

In a further embodiment of the present invention, the most suitable hearing program is only selected after an activation signal has been received by the hearing device user. In other words, the most suitable hearing program is not automatically selected as soon as a new momentary acoustic situation has been detected. This may be of advantage in the case where the suitability measures of two different hearing programs are about equal and the likelihood of switching between this two hearing programs is therefore high. Accordingly, it could have been prevented that the hearing device user is confronted with a switching back and forth between two or even more hearing programs.

The above-described hearing device system cannot only be used within the meaning of a hearing aid which is used to correct a hearing impairment of a person. The present invention is also most suitable to be used with other acoustic communication systems, as for example in radio equipments. In addition, the afore-described present invention or aspects of the present invention may very well be used in connection with binaural hearing devices.

The invention claimed is:

1. Method for adjusting a hearing device in which one of several hearing programs can be selected, the method comprising the steps of:

identifying a momentary acoustic surround situation;

determining a suitability measure for each of the selectable hearing programs according to the identified momentary acoustic surround situation; and assigning a priority to each of the selectable hearing programs according to its suitability measure.

2. Method of claim 1 further comprising the step of automatically selecting the hearing program with the highest suitability measure to operate the hearing device.

3. Method of claim 1 further comprising the step of selecting the hearing program with the highest suitability measure after an activation signal has been received.

4. Method of claim 2 further comprising the step of selecting a hearing program with the next highest suitability measure to the currently selected program upon receiving an activation signal provided that such a hearing program exists.

5. Method of claim 3 further comprising the step of selecting a hearing program with the next highest suitability measure to the currently selected program upon receiving an activation signal provided that such a hearing program exists.

6. Method of claim 4 further comprising the step of selecting a hearing program with the highest suitability measure upon receiving an activation signal and provided that a hearing program with the lowest suitability measure is currently selected.

7. Method of claim 5 further comprising the step of selecting a hearing program with the highest suitability measure upon receiving an activation signal and provided that a hearing program with the lowest suitability measure is currently selected.

8. Method of one of the claims 3 to 7 further comprising the step of generating the activation signal by a remote control unit.

9. Method of one of the claims 3 to 7 further comprising the step of generating the activation signal by an input part of the hearing device.

10. Method of one of the claims 3 to 7 further comprising the step of deriving the activation signal from a manually operated switch or from a code word detected by a speech recognition system.

11. Method of claim 1 further comprising the step of announcing an arrangement or a rearrangement of the selectable hearing programs acoustically.

12. Method of claim 3 further comprising the step of announcing an arrangement or a rearrangement of the selectable hearing programs acoustically.

13. Method of claim 8 further comprising the step of announcing an arrangement or a rearrangement of the selectable hearing programs acoustically.

14. Method of claim 9 further comprising the step of announcing an arrangement or a rearrangement of the selectable hearing programs acoustically.

15. Method of claim 10 further comprising the step of announcing an arrangement or a rearrangement of the selectable hearing programs acoustically.

16. Method of claim 1 further comprising the steps of being able to detect a further input source, and, if a further input source has been detected, of handling the further input source like a further acoustic situation.

17. Method of claim 2 further comprising the steps of being able to detect a further input source, and, if a further input source has been detected, of handling the further input source like a further acoustic situation.

18. Method of claim 3 further comprising the steps of being able to detect a further input source, and, if a further input source has been detected, of handling the further input source like a further acoustic situation.

19. Method of one of the claims 16 to 18 further comprising the step of treating a hearing program with optimal parameters for the further input source as having the second best suitability measure.

20. Hearing device system with a hearing device in which the method of one of the claims 1, 2 or 3 is implemented.

* * * * *

UNITED STATES PATENT AND TRADEMARK OFFICE

CERTIFICATE OF CORRECTION

PATENT NO. : 7,106,870 B2
APPLICATION NO. : 10/718081
DATED : September 12, 2006
INVENTOR(S) : Hilmar Meier et al.

It is certified that error appears in the above-identified patent and that said Letters Patent is hereby corrected as shown below:

ON THE TITLE PAGE

Item (73) Assignee: - Please correct the name of the Assignee by deleting "Phanak" and inserting --Phonak--

Signed and Sealed this

Twentieth Day of March, 2007

JON W. DUDAS
*Director of the United States Patent and Trademark Office*